US005151069A

United States Patent [19]

Skalka

[11] Patent Number: 5,151,069

[45] Date of Patent: Sep. 29, 1992

[54] PLAYGROUND EQUIPMENT

[75] Inventor: Gerald P. Skalka, Washington, D.C.

[73] Assignee: Recreation Technology, Inc., Dunkirk, Md.

[21] Appl. No.: 610,075

[22] Filed: Nov. 5, 1990

[51] Int. Cl.[5] ..... A63B 9/00

[52] U.S. Cl. ..... 482/35; 482/37

[58] Field of Search ..... 272/112, 113; 403/252, 403/258, 260, 263; 482/35-37

[56] References Cited

U.S. PATENT DOCUMENTS

| | | | |
|---|---|---|---|
| 3,969,871 | 7/1976 | Ewers | 272/113 X |
| 4,251,069 | 2/1981 | Bellek | 272/113 |
| 4,252,313 | 2/1981 | Skalka | 272/113 |
| 4,261,665 | 4/1981 | Hsiung | 403/260 X |
| 4,447,055 | 5/1984 | Ahrens | 272/113 |
| 4,682,772 | 7/1987 | Skalka | 272/113 |

FOREIGN PATENT DOCUMENTS

| | | | |
|---|---|---|---|
| 2621549 | 12/1976 | Fed. Rep. of Germany | 272/113 |

OTHER PUBLICATIONS

Popular Mechanics, Jun. 1981, pp. 130, 131, 133, 135.
The Washington Times Magazine, Jun. 26, 1987, p. M3.

*Primary Examiner*—Richard J. Apley
*Assistant Examiner*—D. F. Crosby
*Attorney, Agent, or Firm*—Mason, Fenwick & Lawrence

[57] ABSTRACT

A vertically extending structure comprises a component of playground equipment which is provided with one or more bars having free ends provided with internal threads and configured to penetrate wood, and one or more wooden support members for supporting the component. Each support member has at least one transverse opening extending therethrough. This transverse opening is axially aligned with and receives the free end of the bar, and includes three portions. One portion is inwardly-facing and is of a size and shape to matingly receive and envelop in a supporting fashion one of the free ends; a central portion has a transverse dimension less than that of the inwardly-facing portion; and a third portion is outwardly facing and has a greater transverse diameter than the central portion. The central portion receives the body a bolt, while the outwardly-facing portion receives the head of the bolt. The internal thread of the free end of the bar then threadably engages the threaded end of the bolt, whereby tightening of the bolt pulls the bar of the component into the support member and the innermost extent of the inwardly-facing portion of the transverse opening, to tend to prevent the removal of the component from the inwardly-facing portion if the bolt is removed. Alternatively, the component may include a frame member or the like having opposed, outwardly-extending protrusions, rather than a bar having free ends.

7 Claims, 3 Drawing Sheets

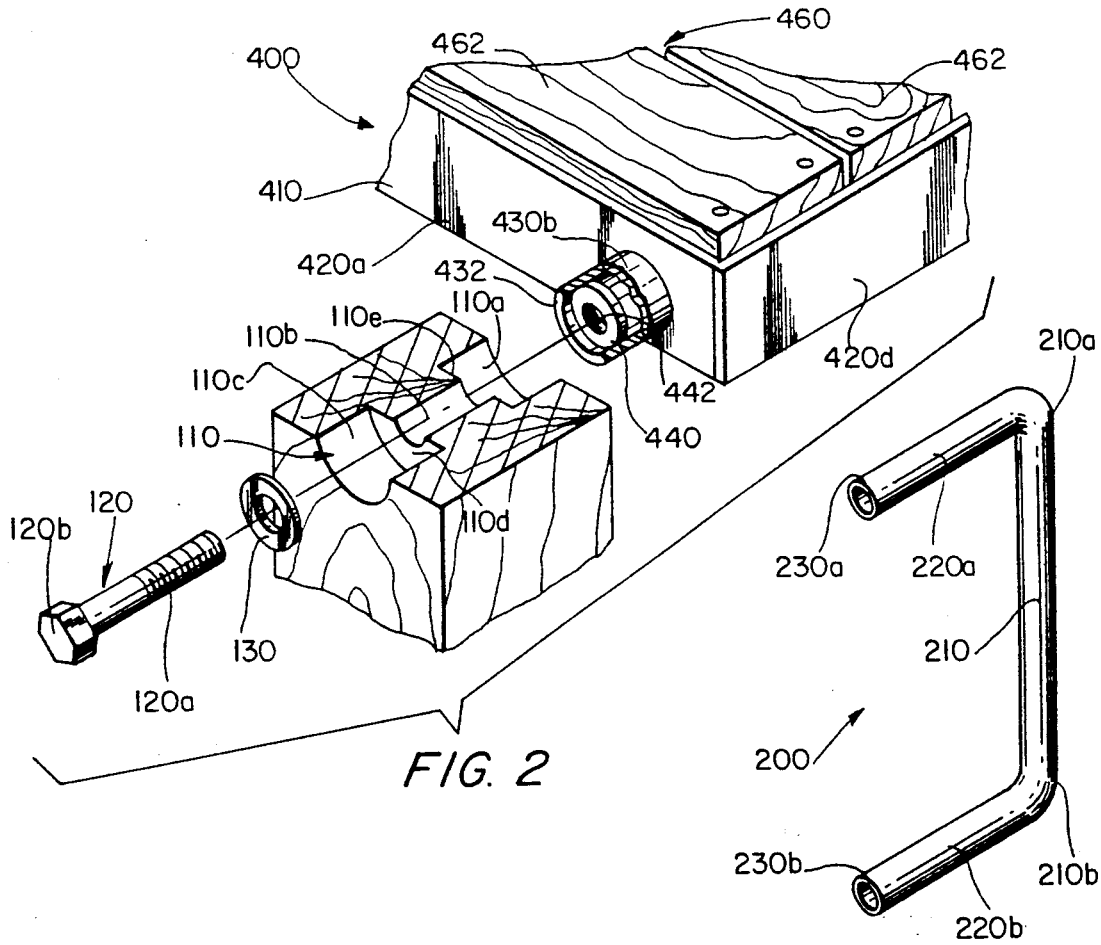
FIG. 2
FIG. 3
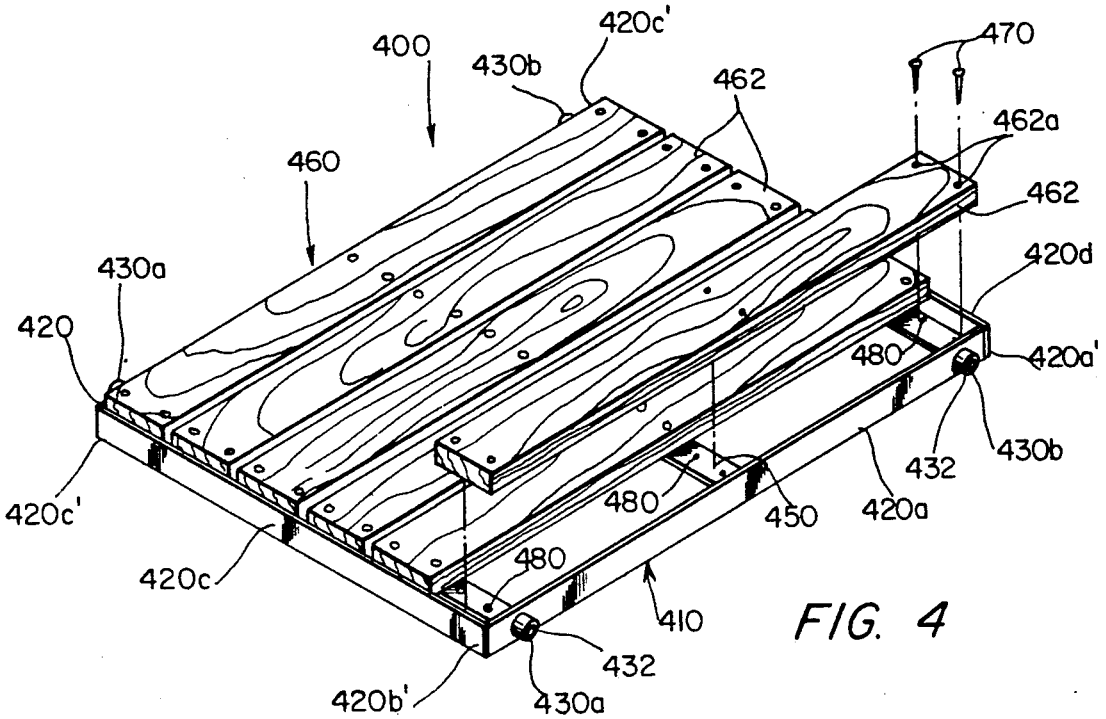
FIG. 4

PLAYGROUND EQUIPMENT

BACKGROUND OF THE INVENTION

This invention is in the field of playground equipment, and is more specifically directed to components such as handrails, guardrails, platforms, and roofs, which incorporate metal bars or protrusions which are supported by wooden supporting posts or the like.

FIELD OF THE INVENTION

Because of its natural appearance and relative sturdiness, playground equipment using wooden supporting posts has become increasingly popular. However, like all playground equipment, playground equipment which employs wooden supporting posts is subjected to a great amount of vandalism. My prior U.S. Pat. No. 4,252,313, which is incorporated herein by reference in its entirety, addressed the problem of vandalism in playground equipment employing wood post members providing support for metal climbing rungs or chinning bars. However, most playground equipment incorporates components other than climbing rungs or chinning bars, for example, platforms or decks, handrails, guardrails, and roofs, as indeed such equipment must in order to provide both a safe and interesting play environment.

Heretofore, components such as handrails, guardrails, platforms, and roofs have been attached to their wooden supporting posts by traditional means such as a collar and nails and screws, as described in my prior U.S. Pat. No. 4,252,313. Thus, such components are susceptible to vandalism, and may even become unsafe if their attachment mechanisms are tampered with.

Therefore, it is the primary object of this invention to provide new and improved playground equipment incorporating components which are vandal-resistant.

It is a further object of the invention to provide playground equipment incorporating components which are supported in such a way as to avoid protrusions and other safety hazards.

SUMMARY OF THE INVENTION

The foregoing and other objects are achieved by provision of a vertically extending structure which comprises a component of playground equipment which is provided with one or more bars having free ends provided with internal threads and configured to penetrate wood, and one or more wooden support members for supporting the component. Each support member has at least one transverse opening extending therethrough. This transverse opening is axially aligned with and receives the free end of the bar, and includes an inwardly-facing portion of a size and shape to matingly receive and envelop in a supporting fashion one of the free ends, a central bolt-body-receiving portion having a transverse dimension less than that of the inwardly-facing portion, and an outer bolt-head-receiving portion having a greater transverse diameter than the central bolt-body-receiving portion. The central bolt-body-receiving portion receives the body a bolt, while the outer bolt-head-receiving portion receives the head of the bolt. The internal thread of the free end of the bar then threadably engages the threaded end of the bolt, whereby tightening of the bolt pulls the bar of the component into the support member and the innermost extend of the inwardly-facing portion of the transverse opening, to tend to prevent the removal of the component from the inwardly-facing portion if the bolt is removed.

In another aspect of the invention, the component may include a frame member or the like having opposed, outwardly-extending protrusions, rather than a bar having free ends.

A better understanding of the disclosed embodiments of the invention will be achieved when the accompanying detailed description is considered in conjunction with the appended drawings, in which like reference numerals are used for the same parts as illustrated in the different figures.

BRIEF DESCRIPTION OF THE DRAWINGS

FIG. 2 is an exploded, partial perspective view of one embodiment of the invention;

FIG. 3 is a perspective view of a handrail member in accordance with the invention;

FIG. 4 is a perspective, partially-exploded view of a platform member in accordance with the invention;

DESCRIPTION OF THE PREFERRED EMBODIMENTS

Figure 1:
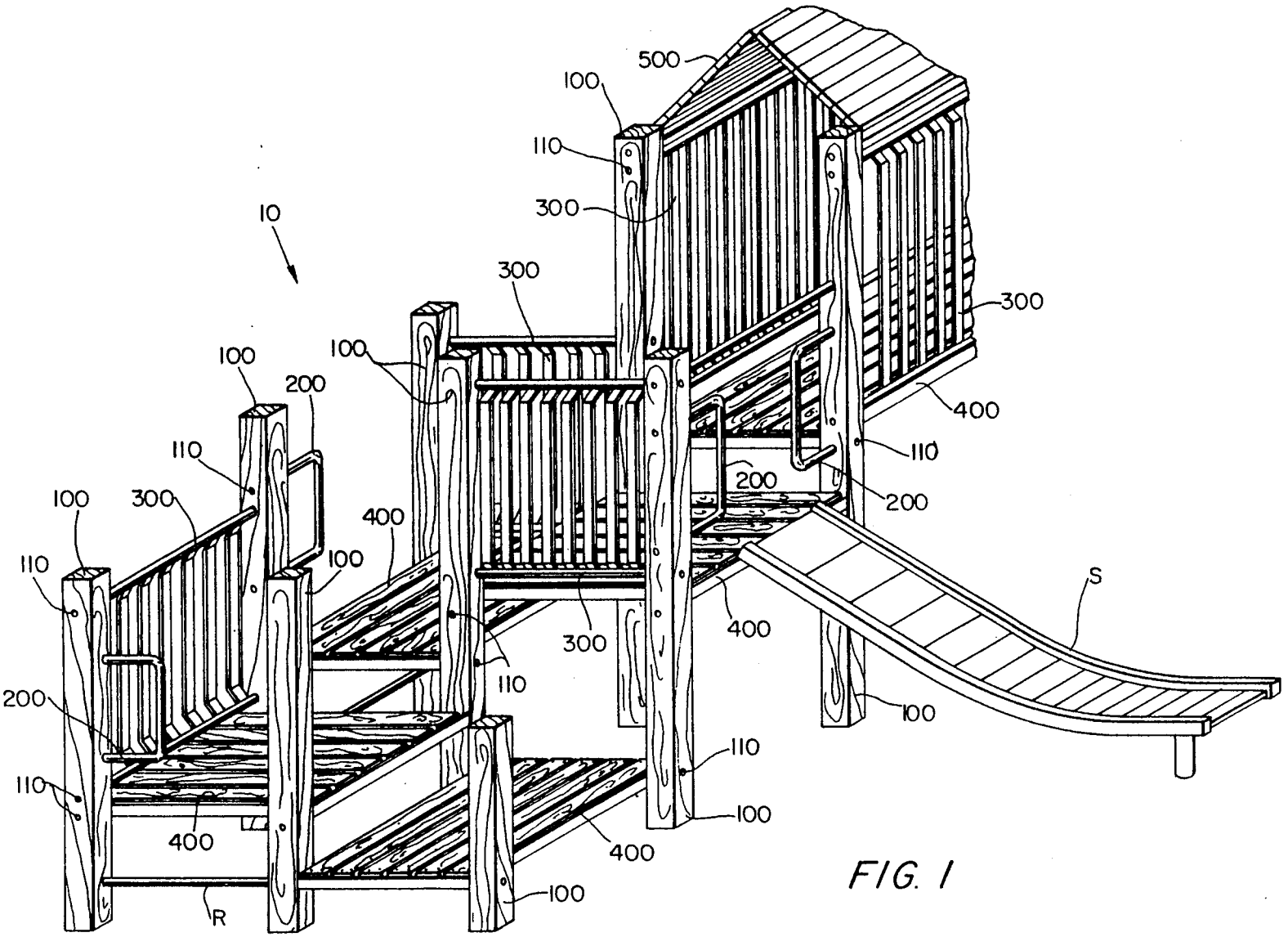
FIG. 1 is a partial perspective view of playground equipment incorporating components and wooden supporting or post members in accordance with the invention.

Referring now to FIG. 1, there is shown an item of playground equipment in accordance with the present invention, generally designated by the reference numeral 10. Playground equipment 10 comprises a plurality of wooden supporting or post members 100, a plurality of handrail members 200, a plurality of guardrail members 300, a plurality of platform members 400, and a roof member 500. As can be appreciated from FIG. 1, each handrail member 200 is supported by a single post member 100, each guardrail member 300 is supported by a pair of opposed post members 100, each platform member 400 and roof member 500 is supported by four post members 100 defining the vertices of a rectangle. Further, the various components can be used in combination. For example, a slide S of conventional design can be attached to a platform member 400 by conventional means, and a guardrail 300 and a pair of opposed handrail members 200 can be used above the platform member 400 to provide an enclosed entrance to slide S. Also, a platform member 400, a pair of opposed guardrail members 300, and a roof member 500 can be combined to provide a covered and partially enclosed play area. Further, a plurality of platform members 400 can be arranged at succeedingly greater heights to provide a multi-level, stair-step type of play area. Rungs R substantially as described in my prior U.S. Pat. No. 4,252,313 can be included between adjacent posts to provide additional stability and a additional climbing surface.

Referring now to FIG. 3, there is shown a handrail member 200. Each handrail member 200 comprises a handle portion 210 having upper and lower ends **210*a* and 210*b*, and upper and lower arms 220*a* and 220*b* extending respectively from upper and lower ends 210*a* and 210*b*. Preferably, handrail members 200 are formed from steel or other metal tubing which has been bent by conventional means into the desired configuration, and which has provided with a powder coating having friction enhancing properties, such as polyester/urethane. The coating can be applied as an electrostatically charged material to the steel, which has been degreased, etched, and phosphatized. The minimum film thickness preferably is 3 mils. Alternatively, handrail members 200** can be formed from galvanized steel. A high-strength, heavy-walled tubular steel, having an outer diameter of 1.315 inches and a wall thickness of 0.102 inch is preferred.

As shown in FIG. 3, handle portion 210 is substantially perpendicularly from linear handle portion 210, and upper and lower arms 220*a* and 220*b* are substantially the same length. However, it will be understood that, for example, upper and lower arms 220*a* and 220*b* could be made different lengths, with linear handle portion 210 extending at an angle between them, and further than handle portion 210 could be other than linear; for example, it could be provided with a gentle curve.

Upper and lower arms 220*a* and 220*b* each have free ends 230*a* and 230*b*, respectively, which are configured to embed in wood (for example, by being provided with sharpened end portions, as described in my U.S. Pat. No. 4,252,313) and have transverse metal plugs inserted therein, as shown at reference numeral 440 in FIG. 200. Plugs 440 are internally welded or pressed in the inner bores of upper and lower arms 220*a* and 220*b* in a position inwardly of free ends 230*a* and 230*b*, as best shown in FIG. 2. Additionally, plugs 440 include an axially positioned threaded surface 442, for a purpose to be described hereinafter.

As best shown by FIG. 1, each handrail member 200 is supported in upper and lower transverse openings formed in a single post member 100, in a manner which will be described in detail hereinafter with respect to FIGS. 2 and 5.

Figure 5:
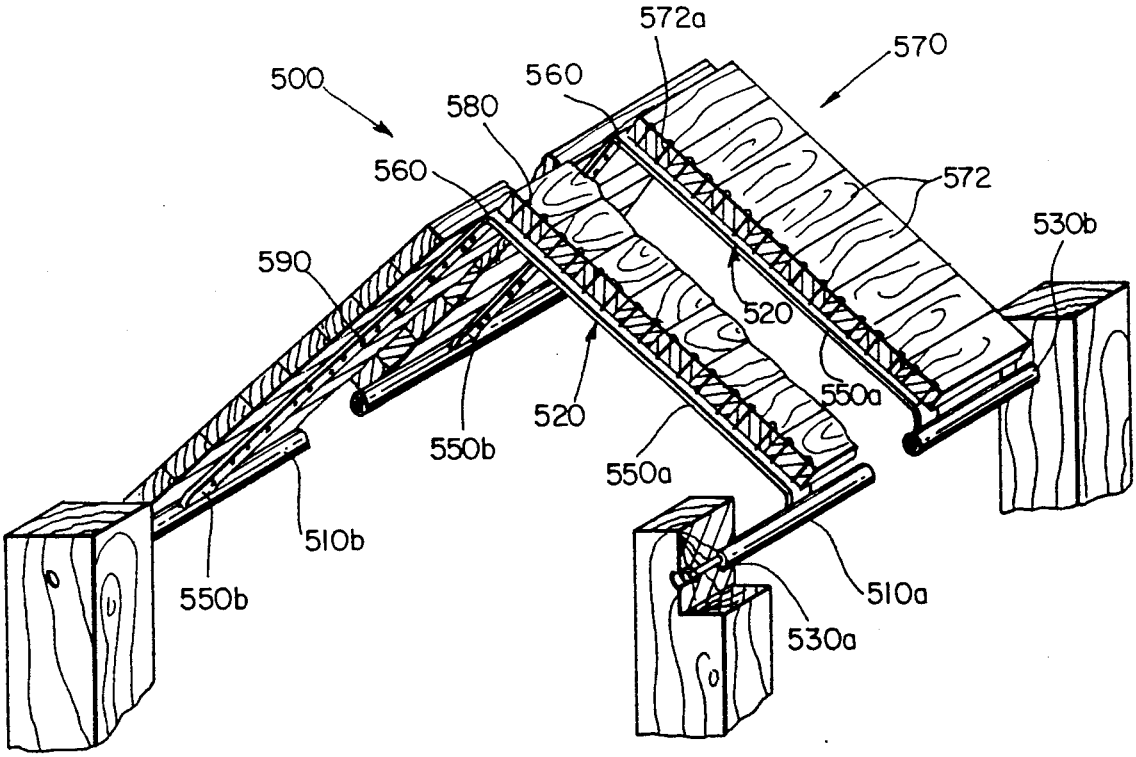
FIG. 5 is a partial perspective view with parts cut away of a roof member in accordance with the invention.
Figure 6:
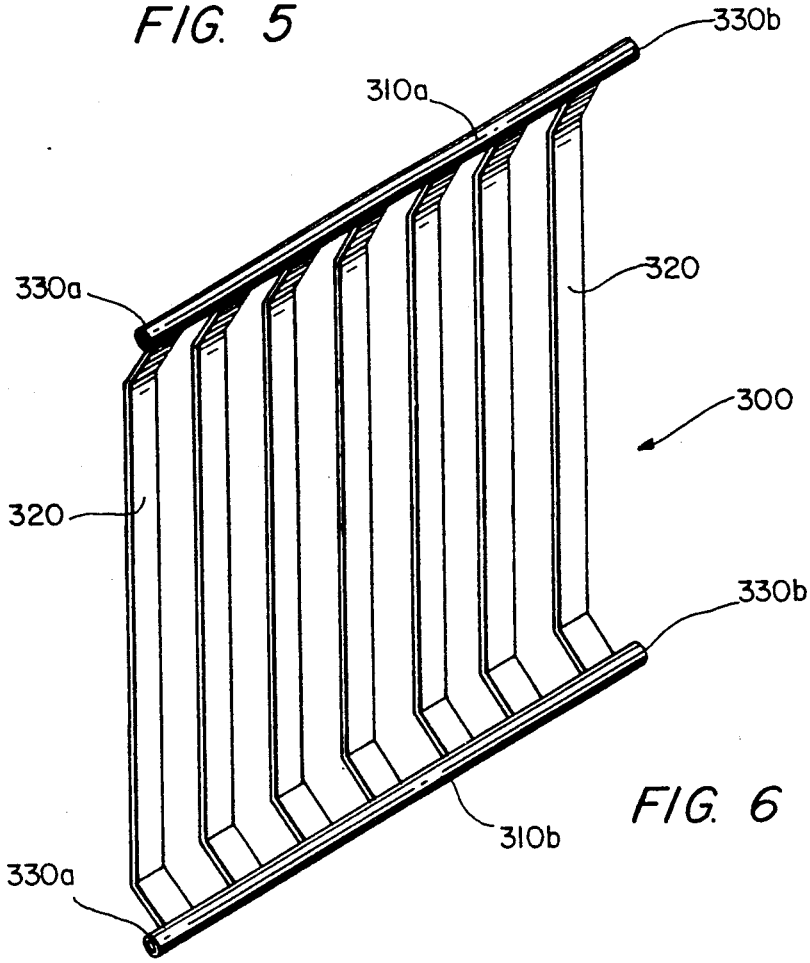
FIG. 6 is a guardrail member in accordance with the invention.

Referring now to FIG. 6, each guardrail member 300 comprises upper and lower horizontal, spaced-apart rails 310*a* and 310*b* having a plurality of posts 320*a* and 320*b* extending between them. Each of rails 310*a* and 310*b* has first and second free ends 330*a* and 330*b* which are configured to embed in wood, for example by sharpening extending outwardly of posts 320. As shown in FIG. 6, free ends 33*a* and 33*b* are coplanar. Rails 310*a* and 310*b* preferably are made from the same kind of metal tubing as guardrail members 200. Metal plugs 440 as shown in FIG. 5 and as described above with respect to the handrail member 200 are provided inwardly of free ends 330*a* and 330*b*.

As shown in FIG. 6, posts 320 are parallel and spaced-apart from each other, and extend perpendicular to rails 310*a* and 310*b*. Further, they are shown as having a substantially U-shaped cross-section, the arms of the U extending at an obtuse angle to the base of the U. Such posts can be formed from flattened metal tubing with flattened crimped ends which are attached to rails 310*a* and 310*b* by welding or other conventional means to form a unitary structure.

As best shown in FIG. 1, each guardrail member 300 is supported by upper and lower transverse openings formed in opposed sides of a pair of post members 100, in a manner which will be described in detail hereinafter with respect to FIGS. 2 and 5.

Referring now to FIG. 4, there is shown a platform member 400. Each platform member 400 comprises a unitary rectangular frame 410 having first and second opposed sides 420*a* and 420*b* and third and fourth opposed sides 240*c* and 240*d*, and four corners 420*a*', 420*b*', 420*c*', and 420*d*'. First and second protrusions 430*a* and 430*b* having edges configured to embed in wood extend outwardly from first and second sides 420*a* and 420*b*, adjacent to but inset from third and fourth sides 420*c* and 420*d*, so that first protrusions 430*a* extending from first and second sides 420*a* and 420*b* are axially aligned, and second protrusions 430*b* extending from first and second sides 420*a* and 420*b* are axially aligned. That is, there are four coplanar protrusions 430 extending outwardly adjacent each of corners 420*a*', 420*b*', 420*c*', and 420*d*'.

Each of protrusions 430*a* and 430*b* is provided with transverse metal plugs 440 internally welded or pressed in their inner bores inwardly of edges 432, as best shown in FIG. 2, and each of plugs 440 includes an axially positioned threaded surface 442, for a purpose to be described hereinafter. Protrusions 430*a* and 430*b* are formed of metal tubing similar to that used for handrail member 200 and bars 310*a* and 310*b* of guardrail member 300, and extend approximately 1 inch from frame 410.

As shown in FIG. 4, sides 420*a*–210*d* are substantially L-shaped in cross-section, the base of each L acting as a joist for the support of a floor 460. Additionally, frame 410 can be provided with at least one joist member 450 extending between two opposed sides 420*a*–420*d* to provide central support for floor 460. As further shown in FIG. 4, floor 460 can comprise a plurality of parallel wooden planks 462 secured to frame 410 by a plurality of screws 470 extending through holes 462*a* in planks 462 and holes 480 in the base of sides 420*a*–420*d* and joist member 450, and conventionally fastened, e.g. by lag screws or bolts (not shown).

As best shown in FIG. 1, each platform member 400 is supported by transversed openings formed in opposed sides of two pairs of post members 100 forming the vertices of a rectangle, in a manner which will be described in detail hereinafter.

Referring now to FIG. 5, there is shown a roof member 500. Each roof member 500 comprises first and second parallel, spaced-apart bars 510*a* and 510*b* and a plurality of rafter members 520 extending upwardly from bars 510*a* and 510*b*. Bars 510*a* and 510*b* to form a unitary structure preferably are made from the same kind of metal tubing as handrail members 200, bars 310*a* and 310*b* of guardrail members 300, and protrusions 430 of platform member 400. Each of bars 510*a* and 510*b* has first and second free ends 530*a* and 530*b* having edges configured to embed in wood and provided with transverse metal plugs 400 as described above with respect to handrail member 200, guardrail member 300, and platform member 400. As shown in FIG. 5, free ends 530*a* and 530*b* are coplanar.

Each of rafter members 520 comprises first and second rafters 550*a* and 550*b* extending upwardly at an angle from first and second bars 510*a* and 510*b*, respectively, to define a peak 560. One pair of rafter members 520 is adjacent to and inset from first ends 530*a* of first and second bars 510*a* and 510*b*, and another pair of rafter members 520 is adjacent to and inset from second ends 530*b* of first and second bars 510*a* and 510*b*, the intersection between those rafter members 520 and bars 510*a* and 510*b* defining a rectangle, and the free ends 530*a* and 530*b* of bars 510*a* and 510*b* extending outwardly from the corners of the rectangle, preferably approximately 1 inch.

Rafter members 520 can be formed from flattened tubing, similar to posts 320 of guardrail member 300, so that the first and second rafters 550*a* and 550*b* of each rafter member 520 are unitary.

Roof member 500 is provided with a covering 570, comprising, for example, a plurality of parallel wooden planks 572. Planks 572 are secured to rafter members 520 by a plurality of screw 580 extending through holes 572*a* in planks 572 and holes 590 in rafter members 520, and conventionally fastened, e.g. by lag screws or bolts.

As shown in FIGS. 1 and 5, roof member 500 is supported by transverse openings formed in opposed sides of two pairs of opposed members 200 forming the vertices of a rectangle, in a manner which will be described in detail hereinafter.

Referring now to FIGS. 1, 2, and 5, each of post members 100 is provided with a transversely extending opening 110 extending completely through post member 100. Transverse opening 110 comprises three distinct and important portions: an inwardly-facing portion 110*a* of sufficient diameter to receive a free end or a protrusion of one of the above-described components, a central bolt-body-receiving portion 110*b* having a diameter less than the diameter of inwardly-facing portion 110*a* , and an outer bolt-head-receiving portion 110*c* having a diameter greater than the diameter of central bolt-body-receiving portion 110*b*. A bolt 120 having a threaded body portion 120*a* and a head 120*b* can then be inserted into each opening 110. As best shown by FIG. 2, a washer 130 is interposed between the bolt head 120*b* and the surface 110*d* defining the inner extent of the outer bolt-head-receiving portion 110*c*.

The apparatus is assembled by first loosely positioning the parts in the manner illustrated in FIG. 5, following which bolts 120 are tightened to pull the end portions of arms 220*a* and 220*b*, rails 310*a* and 310*b*, and bars 510*a* and 510*b*, and protrusions 430*a* and 430*b* into the body of the wood at the surface 110*e* defining the inner extent of inwardly-facing portion 110*a* of transverse opening 110. Arms 220*a* and 220*b*, rails 310*a* and 310*b*, bars 510*a* and 510*b*, and protrusions 430*a* and 430*b* are consequently substantially embedded at their outer ends in the body of the wood, and the frictional engagement of the wood with the tubing surfaces serves to retain them in the wood even if their respective bolts are subsequently removed. The lower ends of post members 100 are then embedded in the ground, for example, by the use of concrete, as shown in FIG. 1 of my prior U.S. Pat. No. 4,252,313. The resultant construction is highly resistant to vandalism, since it retains its structural integrity even if any of bolts 120 are removed; however, the recessed location of bolt heads 120*b*makes removal of bolts 120 difficult, and essentially impossible without the use of tools.

Thus, strong and reliable playground equipment incorporating a variety of components is provided by the invention. Numerous modifications will undoubtedly occur to those of skill in the art; for example, the invention is not limited to usage with vertical post members, and could be used for mounting components between wooden members oriented in practically any direction; also, it will be understood by those of skill in the art that the precise configuration of the various components could be varied without departing from the inventive concept. Thus, it should be understood that the invention is not limited to the disclosed embodiments, and is to be limited solely by the appended claims.

What is claimed is:

1. A vertically extending structure comprising:

a roof member, said roof member comprising first and second parallel, spaced-apart bars and a plurality of rafter members, said rafter members being parallel to each other, each said rafter member comprising first and second rafters extending upwardly at an angle from said first and second bars, respectively, and meeting to form a peak above said first and second bars, and each said rafter member extending upwardly from and being attached to both of said bars to form a unitary structure, each of said bars having first and second free ends, said rafter members being positioned between and offset from said first and second free ends, said free ends being coplanar and each of said free ends being provided with internal threads and including means for penetrating wood, first, second, third, and fourth spaced wooden support members for supporting said roof member, said support member defining the vertices of a rectangle and each having therein a transverse opening extending therethrough, said transverse openings of said first and second support members being axially aligned with and receiving said first and second free ends, respectively, of said first bar, said transverse openings of said third and fourth support members being axially aligned with and receiving said first and second free ends, respectively, of said second bar, said transverse openings each including an inwardly-facing portion of a size and shape to matingly receive and to envelop in a supporting fashion one of said free ends, a central bolt-body-receiving portion having a transverse dimension less than that of said inwardly-facing portion, and an outer bolt-head-receiving portion having a greater transverse dimension than said central bolt-body-receiving portion, and first, second, third, and fourth bolts extending through said transverse openings of said first, second, third, and fourth support members, respectively, each of said bolts having a head and a threaded end threadably engaged with said internal threads of one of said free ends of first and second bars, whereby tightening of said bolts pulls said first and second bars of said roof member into said support members at the innermost extent of said inwardly facing portion of said transverse openings to tend to prevent the removal of said roof member from said inwardly facing portions if any of said bolts is removed, and whereby said roof member rigidly connects said first, second, third, and fourth support members.

2. The structure of claim 1, wherein said roof member further comprises a covering over said rafter members.

3. The structure of claim 2, wherein said covering comprises a plurality of parallel wooden planks attached to said rafter members.

4. The structure of claim 1, wherein said roof members is metal.

5. A vertically extending structure comprising:

a first unitary structural member having four corners and including first, second, third, and fourth protrusions extending outwardly adjacent each of said four corners, said first and second protrusions being axially aligned with each other and said third and fourth protrusions being axially aligned with each other, said first, second, third, and fourth protrusions being coplanar and defining a first plane, and each of said first, second, third, and fourth protrusions being provided with internal threads and including means for penetrating wood, a second unitary structural member having four corners and including fifth, sixth, seventh, and eighth protrusions extending outwardly adjacent each of said four corners, said fifth and sixth protrusions being axially aligned with each other and said seventh and eighth protrusions being axially aligned with each other, said fifth, sixth, seventh, and eighth protrusions being coplanar and defining a second plane perpendicular to said first plane, and each of said fifth, sixth, seventh, and eighth protrusions being provided with internal threads and including means for penetrating wood, first, second, third, and fourth spaced wooden support members for supporting said unitary first and second structural members, said support members defining the vertices of a rectangle and each having therein at least a first transverse opening extending therethrough and two of said support members which are adjacent also having upper and lower transverse openings extend therethrough, said first transverse openings of said first and second support members being axially aligned with and receiving said first and second protrusions, respectively, said first transverse openings of said third and fourth support members being axially aligned with and receiving said third and fourth protrusions, respectively, said upper and lower openings of one of said adjacent support members being axially aligned with and receiving said fifth and seventh protrusions, respectively, and upper and lower openings of the other of said adjacent support members being axially aligned with and receiving said sixth and eighth protrusions, respectively, said transverse openings each including an inwardly-facing portion of a size and shape to matingly receive and to envelop in a supporting fashion one of said protrusions, a central bolt-body-receiving portion having a transverse dimension less than that of said inwardly-facing portion, and an outer bolt-head-receiving portion having a greater transverse dimension than said central bolt-body-receiving portion, and first, second, third, and fourth bolts extending through said first transverse openings of said first, second, third, and fourth support members, respectively, and fifth, sixth, seventh, and eighth bolts extending through said upper and lower openings of said adjacent support members, respectively, each of said bolts having a head and a threaded end threadably engaged with said internal threads of one of said protrusions of said first and second structural members, whereby tightening of said bolts pulls said protrusions into said support members at the innermost extent of said inwardly facing portion of said transverse openings to tend to prevent the removal of said first and second unitary structural members from said inwardly facing portions if any of said bolts is removed, whereby said first and second structural members rigidly connect said first, second, third, and fourth support members in two perpendicular planes.

6. The vertically extending structure of claim 5, wherein said first unitary structural member is a platform member comprising a unitary rectangular frame having opposed first and second sides and opposed third and fourth sides, and wherein said first and second protrusions extend outwardly from said first and second sides, respectively, adjacent said third side, and said third and fourth protrusions extend outwardly from said first and second sides, respectively, adjacent said fourth side.

7. The vertically extending structure of claim 6, wherein said second unitary structural member is a guardrail member comprising upper and lower horizontal, spaced-apart rails and a plurality of posts extending between and attached to said rails to form a unitary structure, and wherein said upper rail has first and second free ends extending outwardly of said posts, said first and second free ends defining said fifth and sixth protrusions, and said lower rail has third and fourth free ends extending outwardly of said posts, said third and fourth free ends defining said seventh and eighth protrusions.

* * * * *